United States Patent [19]

Knapp, Jr. et al.

[11] 4,344,058

[45] Aug. 10, 1982

[54] LOW VOLTAGE CARTRIDGE FUSE DESIGN

[75] Inventors: Edward J. Knapp, Jr., Salisbury; Richard J. Perreault, Amesbury, both of Mass.

[73] Assignee: Gould, Inc., Rolling Meadows, Ill.

[21] Appl. No.: 183,493

[22] Filed: Sep. 2, 1980

[51] Int. Cl.[3] ..... H01H 71/20

[52] U.S. Cl. ..... 337/148; 337/173; 337/244

[58] Field of Search ..... 337/148, 173, 182, 219, 337/244, 267

[56] References Cited

U.S. PATENT DOCUMENTS

| | | | |
|---|---|---|---|
| 3,274,361 | 9/1966 | Ebensteiner et al. | 337/148 |
| 3,412,356 | 11/1968 | Van Horssen | 337/148 X |
| 4,032,877 | 6/1977 | McAlister | 337/148 |

*Primary Examiner*—George Harris

*Attorney, Agent, or Firm*—Erwin Salzer

[57] ABSTRACT

This invention relates to electric fuses meeting the requirements of Underwriter's RK1 classification. It includes a high-current interrupter in the form of a fusible element having serially arranged points of reduced cross-section and a low-current interrupter in the form of a plunger soldered to the high-current interrupter. The plunger is spring biased, and when the solder joint softens, the plunger separates under the action of the spring from the fusible element leaving a large gap between them. The separation of the plunger from the fusible element is allowed to be particularly large on account of the fact that the plunger may be allowed to move into a special fuse cap, known as a cap having a rejection feature as described, for instance, in U.S. Pat. No. 2,943,295 to V. N. Stewart; June 28 1960 for REJECTION TYPE FUSE CLIP and in many other patents.

13 Claims, 4 Drawing Figures

LOW VOLTAGE CARTRIDGE FUSE DESIGN

BACKGROUND OF THE INVENTION

This invention relates to an electric fuse capable of meeting the requirements of the Underwriter's RK1 classification.

Another object of this invention is to provide an electric fuse that lends itself to semi-automatic, or fully automatic, production.

Another object of this invention is to provide a fuse whose low current interruption is effected by a contact in form of a spring-biased plunger the degree of heat absorbing capacity of which controls the time-lag of the fuse.

Such a plunger has the advantage of providing a long contact travel which can be further extended by allowing the plunger to travel into the terminal cap having the rejection feature referred-to above.

Such a plunger has further the advantage that its mass, and hence the time-lag of the fuse, can readily be increased, if necessary.

Another object of the invention is to provide a fuse having a heating element of the required resistivity and not being subject to the limitations of a coil heater of wire. Conventional coil heaters become very critical at higher current ratings owing to the lower resistance needed under such conditions. To be more specific, coil heaters for high-current ratings become very critical because the wire coils are short and the diameter of the wire is large. Strip heaters are not subject to this drawback. The resistance material of which they are made is more manageable in comparison to coil heaters and allows for larger working dimensions and tolerances.

Other objects and advantages of the invention will become more apparent as this specification proceeds.

SUMMARY OF THE INVENTION

This invention relates to the electric fuses comprising a casing of electric insulating material closed on both ends thereof by a pair of terminal caps. The fuse further includes separate means for interrupting major fault currents and for interrupting overload currents arranged in said casing and serially connected to each other. Said means for interrupting major fault currents include a fusible element of sheet metal having serially arranged points of reduced cross-section. Said means for interrupting overload currents include a spring-biased contact inserted into the circuit by one or more solder joints. The casing is filled with a pulverulent arc-quenching filler, preferably quartz sand.

The improvement according to the present invention comprises (a) a contact in the form of a plunger soldered by a first solder joint to one of the ends of said fusible element and acted upon by a helical spring tending to break said first solder joint;

(b) a tubular metal sleeve surrounding said plunger with a clearance left between said metal sleeve and said plunger;

(c) a second solder joint precluding entry of said arc-quenching filler into said metal sleeve by way of said clearance between said metal sleeve and said plunger;

(d) a heating element of sheet metal extending along the outer surface of said metal sleeve for heating said metal sleeve and said plunger, said heating element having current-carrying tab means interposed between the outer surface of said casing and one of said pair of terminal caps; and (e) electric insulating means interposed between said heating element of sheet metal and said metal sleeve for insulating said heating element from said metal sleeve, said insulating means including an insulating sleeve surrounding said metal sleeve.

DESCRIPTION OF PREFERRED EMBODIMENT

Figure 3:
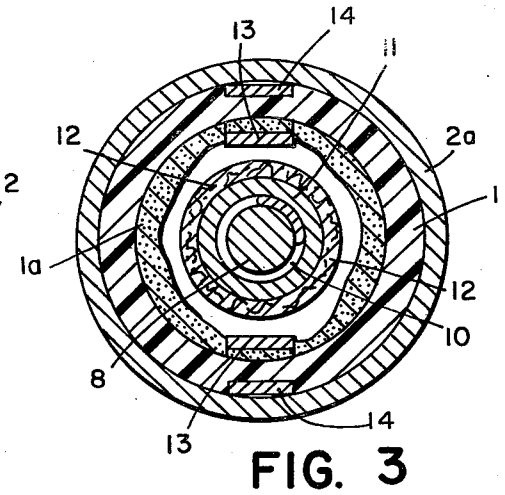
FIG. 3 is a cross-section along III—III of FIG. 2.
Figure 4:
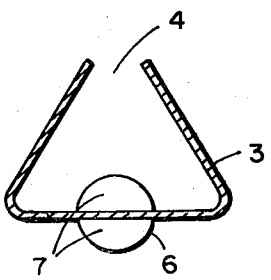
FIG. 4 is a cross-section along IV—IV of FIG. 1.
Figure 1:
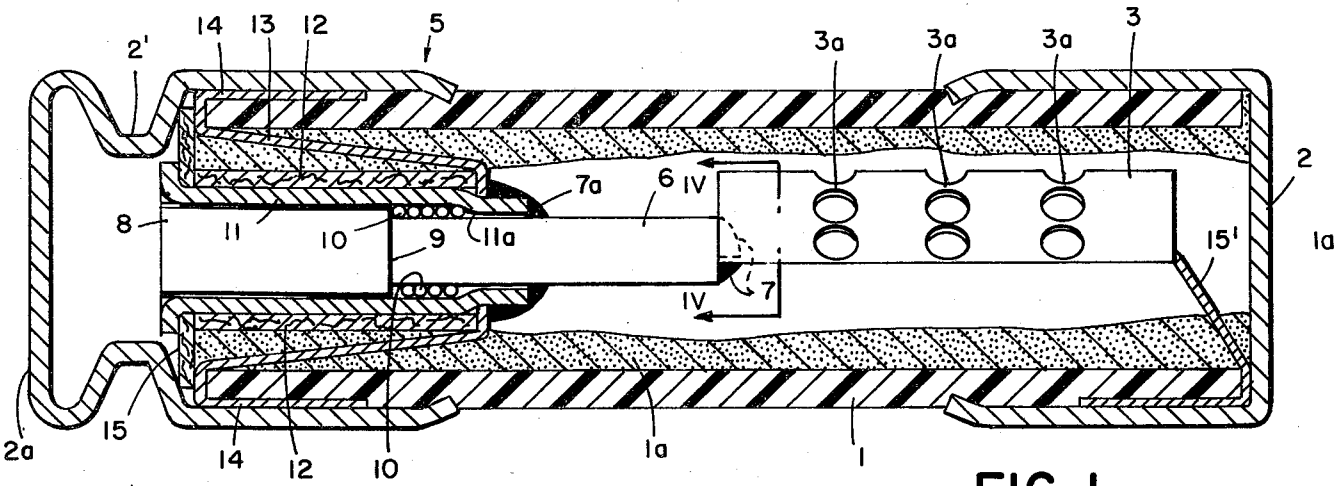
FIG. 1 shows in longitudinal section a complete fuse assembly according to this invention in its original state, i.e. neither blown on low currents or on high currents.

Referring now to the drawings, numeral 1 has been applied to indicate a tubular casing of electric insulating material, e.g. a synthetic-resin-glass-cloth laminate. Both ends of casing 1 are closed by a pair of terminal caps 2 and 2*a*. Terminal cap 2 is a standard cap, while terminal cap 2*a* is a terminal cap having a rejection feature, which term wil be explained below in greater detail. Reference numeral 3 has been applied to indicate a fusible element adapted to interrupt major fault currents. It is formed by a sheet of metal bent substantially triangularly in cross-section, having serially arranged points of reduced cross-section 3a. A gap 4 is formed between the juxtaposed edges of the sheet metal of which fusible element 3 is made.

Reference numeral 5 has been applied to generally indicate the low-current interrupting means of the fuse. They include a plunger 6 whose diameter increases slightly from right to left. The right end of plunger 6 is soldered at 7 to fusible element 3. Plunger 6 has an axially outer end 8 whose diameter is larger than the diameter at the right end of plunger 6, the purpose of this feature consisting in increasing the mass and the heat absorbing capacity of the structure 6,8. Plunger 6 and its extension 8 form a shoulder at 9 against which the helical springs 10 rests. A tubular metal sleeve 11 surrounds plunger 6 and its extension 8. Sleeve 11 is flaring radially outwardly at its left or axially outer end. While the left end of spring 10 rests against shoulder 9, it right end rests against a shoulder 11*a* of sleeve 11 and thus biases parts 6 and 8 from right to left, tending to break solder joint 7 when the latter softens. There is a clearance between plunger 6 and its axially outer end 8, on the one side, and metal sleeve 11, on the other side. Casing 1 is filled with a pulverulent arc-extinguishing filler 1a, preferably quartz sand of 30/40 microns. The arc-quenching filler 1a must be precluded from entering into the clearance or gap between parts 6,8 and 11. To this end a second solder joint 7*a* closes the gap between parts 6 and 11. Solder joints 7 and 7*a* have the same softening temperature, so that both soften simultaneously and allow spring 10 to move parts 6 and 8 from right to left. Metal sleeve 11 is surrounded by a tubular insulating sleeve 12 which may, for instance, be made of cardboard. Reference numeral 13 has been applied to indicate a heating element of sheet metal extending along the outer surface of insulating sleeve 12. Heating element 13 has one or more current-carrying tabs or tab means 14 interposed between the outer surface of casing 1 and one of terminal caps, i.e. the left terminal cap 2a. Heating element 13 has a bottom which may be circular through which tubular metal sleeve 11 and plunger 6 project. Sealing joint 7a interconnects the right end of sleeve 11 and the circular bottom of heating element 13 with the plunger 6, thus precluding filler 1a from entering into the space for spring 10. The number of current-carrying tabs is optional. In the embodiment of the invention shown there are two current-carrying tabs 14, this being the preferred embodiment of the invention, because it provides a symmetrical support for heating element 13. There is no reason, however, why the sheet metal heating element 13 should not be supported by three tabs angularly displaced 120 deg. An insulating means such as, e.g., an insulating washer 15 is interposed between the left somewhat outwardly flaring end of metal sleeve 11 and heating element 13 to preclude shunting of heating element 13 by metal sleeve 11.

It will be understood from the above tht the normal current path through the fuse is as follows: Terminal cap 2a, tabs 14, heating element 13, solder joint 7a, plunger 6, solder joint 7, fusible element 3, metal strip 15', and terminal cap 2. If parts 13 and 11 were not insulated by insulating washer 15, or an element equivalent to washer 15 and performing the same function as washer 15, a portion of the heating current which should flow only through heater 13 might be divered to flow through tubular metal element 11 and through parts 8,6. Such a shunt would completely derate the fuse and must, therefore, be avoided.

The heating effect of parts 13,14 depends on the restivity per unit of area, such as 1 square inch, or 1 $cm^2$. In other words, the heating effect to be exercised on parts 6,8 and solder joints 7 and 7a depends on this resistivity. The metal marketed under the trademark CUPRON of the Wilber Driver Co. has proven to be most satisfactory for manufacturing the sheet resistor 13,14. Cupron is an alloy of 55% Ag and 45% Ni. The strip heater 13,14 may also be made of phosphor bronze.

As mentioned above, heater 13 may have one or more than one terminal tabs 14. The provision of heater 13 with two terminal tabs 14 has the advantage of centering the low current interrupting assembly 6,8,10,11,12 etc. in its entirety in coxial relation with casing 1.

The right end of fusible element 3 is conductively connected to the terminal cap 2 by the strip of sheet metal 15' of substantially uniform cross-section and smaller width than fusible element 3. Part 15' is also of a metal of smaller resistivity than part 3. The fusible element may, for instance, be of phosphor bronze or nickel silver, while strip 15' may be of sheet copper so that the voltage drop from the point of contact of parts 3 and 15' to the point of contact between the parts 15' and 2 be minimized.

Figure 2:
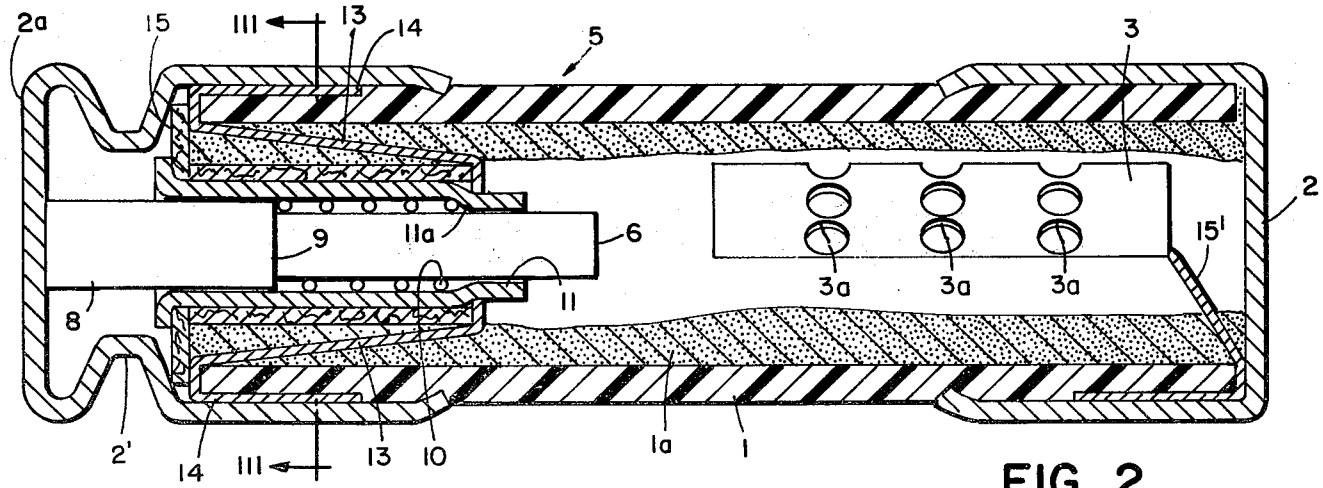
FIG. 2 shows the same structure as FIG. 1 in the same way as FIG. 1 blown on a low protracted overload.

Fuse terminal caps 2 and 2a differ in regard to their geometry. Cap 2a is longer than cap 2 and has rejection means which is, in essence, a groove, or portion of smaller radius, or restricted cross-sectional area 2'. As shown in the above referred-to patent to Stewart U.S. Pat. No. 2,943,295 this groove is a means for preventing insertion of the fuse in an improper fuse clip or fuse holder. The fuse clip or fuse holder is provided with a so-called interference member which is accommodated in groove 2', but rejects the fuse if no groove or like recess is provided for receiving the interference member. In the structure shown the recess of terminal cap 2a serves the purpose of preventing improper insertion of fuses into fuse holders which should not receive the particular fuses. The space inside cap 2a which is considerably longer than cap 2 receives plunger 8 upon blowing of the fuse on overload currents, and thus makes it possible to maximize the spacing between parts 3 and 6 (FIG. 2).

In case of major fault currents the fusible element 3 is more or less vaporized, which leads to interruption of the faulted circuit. In case of overload currents strip heater 13,14 heats plunger 9 to such an extent that fusible joints 7 and 7a soften. This enables spring 10 to move plunger 6 and its axially outer end 8 from right to left, thus breaking the current path between plunger 6 and fusible element 13.

While we have described above the preferred embodiment of our invention, it is apparwent that some modifications thereof may be made resulting, however, in a decrease of its operating characteristics.

For instance, but the high-current interrupting capacity fusible element 3 may be embedded in a pulverulent arc-quenching filler 1a, and the low-current interrupting means 5 may merely be immersed in air. Such a modification of the preferred embodiment of the invention would require a transversely arranged partition in casing 1 having an aperture through which plunger 6 projects. The clearance or gap between that aperture and plunger 6 might be sealed with silicone grease, to prevent the arc-quenching filler to move from the high-current interrupting portion to the low-current interruption portion of the fuse.

The solder joint 7a performs two functions. It prevents the pulverulent arc-quenching filler 1a from entering into sleeve 11, and it fixes the point where the current through heater parts 13,14 enters plunger 6. The first mentioned function may be performed by the above partition if the presence of arc-quenching filler 1a is dispensed within the low-current interrupting section 5. The grain size of filler 1a may also be selected to be so large as to avoid its intrusion into the gap formed between parts 6 and 11. But each of these proposed short-cuts, though better than prior art devices, has an adverse effect on the performance of the preferred embodiment of the invention, as described and shown in the drawings.

We claim as our invention:

1. An electric fuse comprising a casing of electric insulating material closed on both ends thereof by a pair of terminal caps; separate means for interrupting major fault currents and for interrupting overload currents arranged in said casing and serially connected to each other; said means for interrupting major fault currents including a fusible element of sheet metal having serially arranged points of reduced cross-section; said means for interrupting overload currents including a spring-biased contact inserted into the circuit by one or more solder joints; and a pulverulent arc-quenching filler inside said casing wherein the improvement comprises (a) a contact in the form of a plunger soldered by a first solder joint to one of the ends of said fusible element and acted upon by a helical spring tending to break said first solder joint;

(b) a tubular metal sleeve surrounding said plunger with a clearance between said metal sleeve and said plunger;

(c) a second solder joint precluding entry of said arc-quenching filler into said metal sleeve by way of said clearance between said metal sleeve and said plunger;

(d) a heating element of sheet metal extending along the outer surface of said metal sleeve for heating said metal sleeve and said plunger, said heating element having current-carrying tab means interposed between the outer surface of said casing and one of said pair of terminal caps; and (e) electric insulating means interposed between said heating element of sheet metal and said metal sleeve for insulating said heating element from said metal sleeve, said insulating means including an insulating sleeve surrounding said metal sleeve.

2. An electric fuse as specified in claim 1 wherein said heating element of sheet metal is symmetrical relative to a plane including the longitudinal axis of said casing and has a plurality of tabs overlapping the outer surfce of said casing and wherein said heating element of sheet metal has an aperture through which said metal sleeve and said plunger project.

3. An electric fuse as specified in claim 1 wherein said metal sleeve is radially flaring out at the axially outer end thereof, and wherein a washer of insulating material is interposed between said flaring out end of said metal sleeve and said heating element of sheet metal.

4. A fuse as specified in claim 1 wherein said helical spring is arranged between said plunger and said metal sleeve and wherein said helical spring abuts with one end thereof against a shoulder formed by said plunger and abuts with the opposite end thereof against a surface formed by said metal sleeve.

5. A fuse as specified in claim 1 wherein said fusible element is conductively connected to one of said pair of terminal caps immediately adjacent thereto by a strip of sheet metal of substantially uniform cross-section, of smaller width than said fusible element, and of a metal having a smaller resistivity than the metal of which said fusible element is comprised.

6. A fuse as specified in claim 1 wherein said insulating means include in addition to said insulating sleeve surrounding said metal sleeve an insulating washer at the axially outer end of said metal sleeve.

7. A fuse as specified in claim 1 wherein said second solder joint joins said heating element, said metal sleeve and said plunger at a predetermined point saturated substantially midway of said plunger.

8. A fuse as specified in claim 1 wherein one of said pair of terminal caps has a portion of restricted external diameter in the lateral surface thereof situated between the axially inner end and the end surface thereof to preclude insertion of the fuse into a fuse holder lacking an interference member engaging said portion of restricted external diameter, and wherein said plunger is adapted to move upon softening of said first and said second solder joint in a direction longitudinally thereof through said portion of restricted external diameter into engagement with said end surface of said one of said pair of terminal caps.

9. An electric fuse comprising (a) a casing of electric insulating material;

(b) a pair of terminal caps including a first terminal cap and a second terminal cap closing the ends of said casing;

(c) said first terminal cap having a relatively small distance from the axially inner end thereof to the axially outer end surface thereof, and said first terminal cap having a cylindrical lateral wall uninterrupted by rejection means in form of a circular groove;

(d) said second terminal cap having a relatively large distance from the axially inner end thereof to the axially outer end surface thereof and said second terminal cap having a cylindrical lateral wall interrupted by rejection means in form of a circular groove.

(e) an elongated fusible element having a plurality of serially arranged points of reduced cross-section inside said casing at the end thereof closed by said first terminal cap and conductively connected to said first terminal cap;

(f) a plunger arranged inside said casing and conductively connected by a first solder joint to the end of said fusible element remote from said first terminal cap and biased by a helical spring arranged in coaxial relation to said plunger away from said first terminal cap toward said second terminal cap;

(g) an electric strip heater conductively connected with one end thereof to said second terminal cap and a second solder joint conductively connecting the other end of said strip heater to said plunger, a portion of said strip heater extending substantially along said plunger and reducing when energized by current flow the holding power of said first solder joint and the holding power of said second solder joint; and (h) the travel of said plunger under the action of said helical spring away from said first solder joint being sufficiently large to cause abutting engagement of said plunger and of said axially outer end surface of said second terminal cap.

10. An electric fuse as specified in claim 9 wherein said casing is filled with a pulverulent arc-quenching filler and wherein said plunger is surrounded by a metal sleeve sealed by said second solder joint to preclude entry of said pulverulent arc-quenching filler into said metal sleeve.

11. An electric fuse as specified in claim 10 wherein (a) said strip heater has a perforated center portion and two arms extending from said center portion;

(b) said metal sleeve and said plunger project through said perforated center portion of said strip heater;

(c) said two arms of said strip heater extend along said metal sleeve to heat said metal sleeve and said plunger;

(d) said strip heater has a plurality of terminals bent around the rims of said casing and clamped between the outer surface of said casing and the inner surface of said second terminal cap; and (e) wherein electric insulating means insulate said strip heater from said metal sleeve and said plunger.

12. An electric fuse as specified in claim 9 wherein said strip heater, said plunger and a metal sleeve surrounding said plunger are maintained in coaxial relation with said casing by means of clamping one end of said strip heater between said second terminal cap and said casing and by the position of said first and second solder joints.

13. An electric fuse as specified in claim 9 wherein said second solder joint conductively connects said plunger, a metal sleeve surrounding said plunger and said strip heater at a predetermined point, and wherein the solder of which said first solder joint is composed and the solder of which said second solder joint is composed have substantially the same softening temperature.

* * * * *